US008046966B2

(12) United States Patent
Moore et al.

(10) Patent No.: US 8,046,966 B2
(45) Date of Patent: Nov. 1, 2011

(54) SUSPENDED CEILING ASSEMBLY

(76) Inventors: Mahlon L. Moore, Coon Rapids, MN (US); Gregory T. Moore, Coon Rapids, MN (US)

( * ) Notice: Subject to any disclaimer, the term of this patent is extended or adjusted under 35 U.S.C. 154(b) by 732 days.

(21) Appl. No.: 10/949,749

(22) Filed: Sep. 24, 2004

(65) Prior Publication Data

US 2005/0086888 A1 Apr. 28, 2005

Related U.S. Application Data

(60) Provisional application No. 60/514,023, filed on Oct. 24, 2003.

(51) Int. Cl.
*E04B 2/00* (2006.01)

(52) U.S. Cl. ..... 52/506.06; 52/220.6; 52/665; 52/715

(58) Field of Classification Search .. 52/506.06–506.09, 52/665, 702, 712, 715, 719, 220.6, 506.1; 403/232.1, DIG. 15

See application file for complete search history.

(56) References Cited

U.S. PATENT DOCUMENTS 2,611,160 A * 9/1952 Hanesse ..... 403/237
3,319,389 A * 5/1967 Levine ..... 52/309.1
3,385,020 A * 5/1968 Olson ..... 52/666
3,809,358 A * 5/1974 Hazeley ..... 248/317
3,989,398 A * 11/1976 Wendt ..... 403/230
4,004,390 A * 1/1977 Merkwitz ..... 52/506.07
4,019,300 A * 4/1977 Sauer et al. ..... 52/665
4,089,146 A * 5/1978 Martinez ..... 52/506.08
4,198,175 A * 4/1980 Knepp et al. ..... 403/191
4,281,498 A 8/1981 Kern
4,367,616 A 1/1983 Pearson
4,454,700 A 6/1984 Kern
4,464,876 A 8/1984 Kern
4,498,801 A * 2/1985 Gilb ..... 403/232.1
4,505,083 A * 3/1985 Mieyal ..... 52/476
4,525,971 A 7/1985 Kern
4,527,375 A * 7/1985 Braginetz ..... 52/712
4,561,230 A * 12/1985 Rionda et al. ..... 52/289
4,569,175 A * 2/1986 Abciuk ..... 52/506.07
4,580,387 A * 4/1986 Rogers ..... 52/665
4,624,088 A * 11/1986 Arent ..... 52/506.07
4,625,488 A 12/1986 Kern
4,674,254 A 6/1987 Koehler
4,722,161 A 2/1988 Young
4,773,200 A 9/1988 Young
4,841,709 A 6/1989 Peterson et al.
4,893,961 A * 1/1990 O'Sullivan et al. ..... 403/232.1
5,218,808 A 6/1993 Ardley
5,239,801 A 8/1993 Adams
5,261,204 A 11/1993 Neff
5,279,090 A * 1/1994 Yamaguchi et al. ..... 52/506.08

(Continued)

*Primary Examiner* — William Gilbert
(74) *Attorney, Agent, or Firm* — Brooks, Cameron & Huebsch, PLLC

(57) ABSTRACT

A suspended ceiling assembly preferably formed of wood or wood-like material for aesthetic purposes. A ceiling panel grid is formed of ceiling panel support members that include runners and cross members arranged in intersecting relationship forming cells that support ceiling tiles. A plurality of parallel runners are installed between opposed room walls. Cross members are installed in perpendicular relationship to the runners and are intersected by the runners. The runners extend from wall to wall. The cross members extend between one runner and the next. The support members have a cross-sectional shape of an inverted "T" to provide a seat for a ceiling tile. A unique unibody connector at the intersection of the cross members and runners secures the cross members to the runners.

13 Claims, 6 Drawing Sheets

U.S. PATENT DOCUMENTS 5,349,800 A * 9/1994 Peng ..... 52/506.06
5,619,833 A 4/1997 Neff
5,979,134 A 11/1999 Neff
6,209,268 B1 * 4/2001 Schmidt ..... 52/92.1
6,230,467 B1 * 5/2001 Leek ..... 52/702
6,729,096 B1 * 5/2004 Ashmore et al. ..... 52/506.06
6,837,019 B2 * 1/2005 Collie ..... 52/712
6,840,021 B1 * 1/2005 Ashmore et al. ..... 52/506.05
6,851,238 B2 * 2/2005 Rebman ..... 52/506.07
7,207,144 B2 * 4/2007 Shepard ..... 52/506.05
7,269,927 B2 * 9/2007 Savard ..... 52/506.06
2008/0060306 A1 * 3/2008 Platt et al. ..... 52/506.06

* cited by examiner

SUSPENDED CEILING ASSEMBLY

CROSS REFERENCE TO RELATED APPLICATION

This application claims the benefit of U.S. Provisional Application Ser. No. 60/514,023 filed Oct. 24, 2003.

BACKGROUND OF THE INVENTION

Suspended ceilings are popular. They are used in buildings where there are exposed rafters, duct work, pipes and electrical wiring. The suspended ceiling is positioned beneath such structure in order to provide an acceptable ceiling. In older homes with high ceilings that have fallen into disrepair, a suspended ceiling may be installed for aesthetic purposes.

Typically the suspended ceiling involves a framework which is suspended from overhead ceiling rafters or an existing ceiling. The framework has a grid work of long runner members and cross members which form individual rectangular openings. Drop-in ceiling panels are positioned in the openings. Light fixtures and vents and such as may be required are installed in openings in the ceiling panels.

SUMMARY OF THE INVENTION

The present invention pertains to a suspended ceiling assembly and in particular, one that is preferably formed of wood or wood-like material for aesthetic purposes. The suspended ceiling assembly includes a ceiling panel grid formed of ceiling panel support members that extend between perimeter members. The support members include long runner members or runners, and cross members. A plurality of parallel runners are installed across the room between opposed walls. Cross members are installed in perpendicular relationship to the runners. The runners extend from wall to wall. The cross members extend between one runner and the next. The support members, both runners and cross members, have a cross-sectional shape of an inverted "T." The upright leg or stringer of the T is connected to hanger members that are connected to the overhead structure. The horizontal base of the T has a sideway ledge that extends out from the stringer to provide a seat for a ceiling tile.

A unique connector at the intersection of the cross members and runners secures the cross members to the runners. The connector has a top wall or connector plate that is positioned on the top surface of a runner spanning the intersection of the runner with two cross members. First and second pairs of legs straddle the runner and are fixed to it on opposite sides of the intersection with the cross members. Third and fourth pairs of legs are fixed to and straddle the cross members on opposite sides of the runners. The legs are attached to the connector plate. The connector thereby holds the two cross members in position with respect to the intersecting runner.

The runners and cross members form an array of rectangular or square openings. Drop-in ceiling panels are installed in each opening with the perimeters of the ceiling panels resting on the seats provided by the horizontal ledges of each of the support members. The ceiling panels can be wooden or simulated wood-grain.

IN THE DRAWINGS

DESCRIPTION OF A PREFERRED EMBODIMENT

Figure 1:
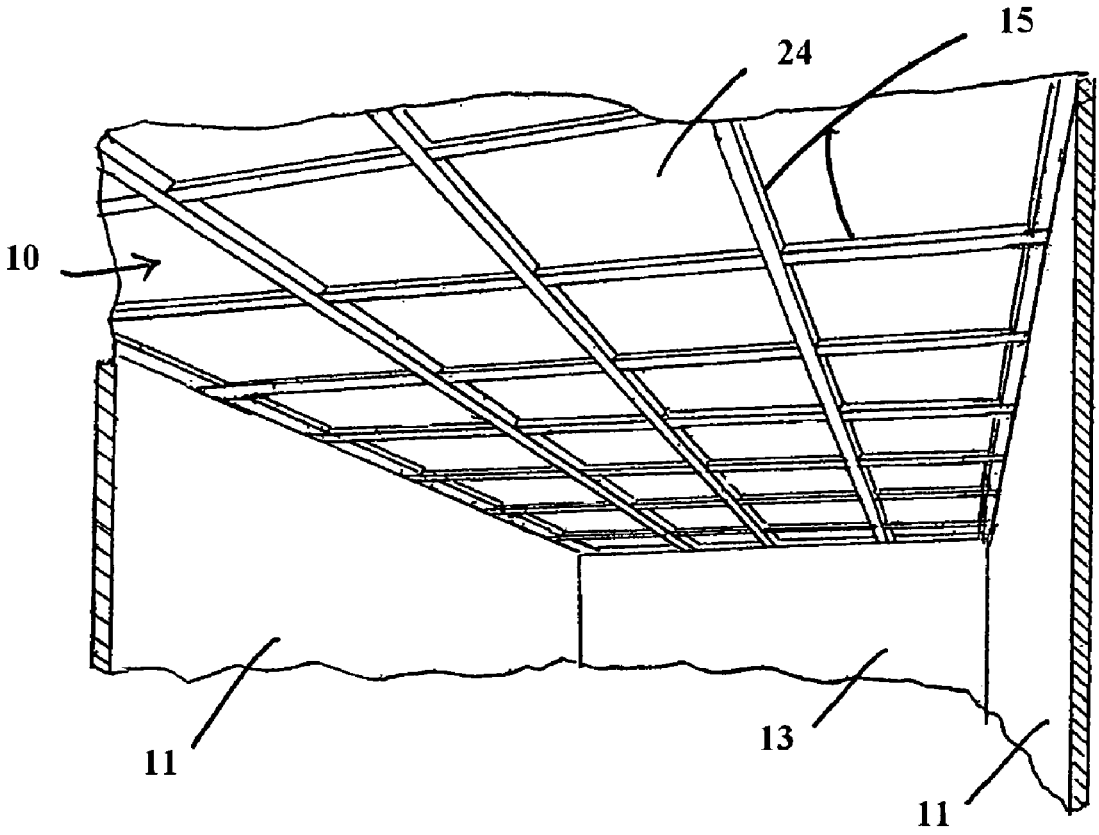
FIG. 1 is a view in perspective looking up at a suspended ceiling according to the invention installed in a room.
Figure 2:
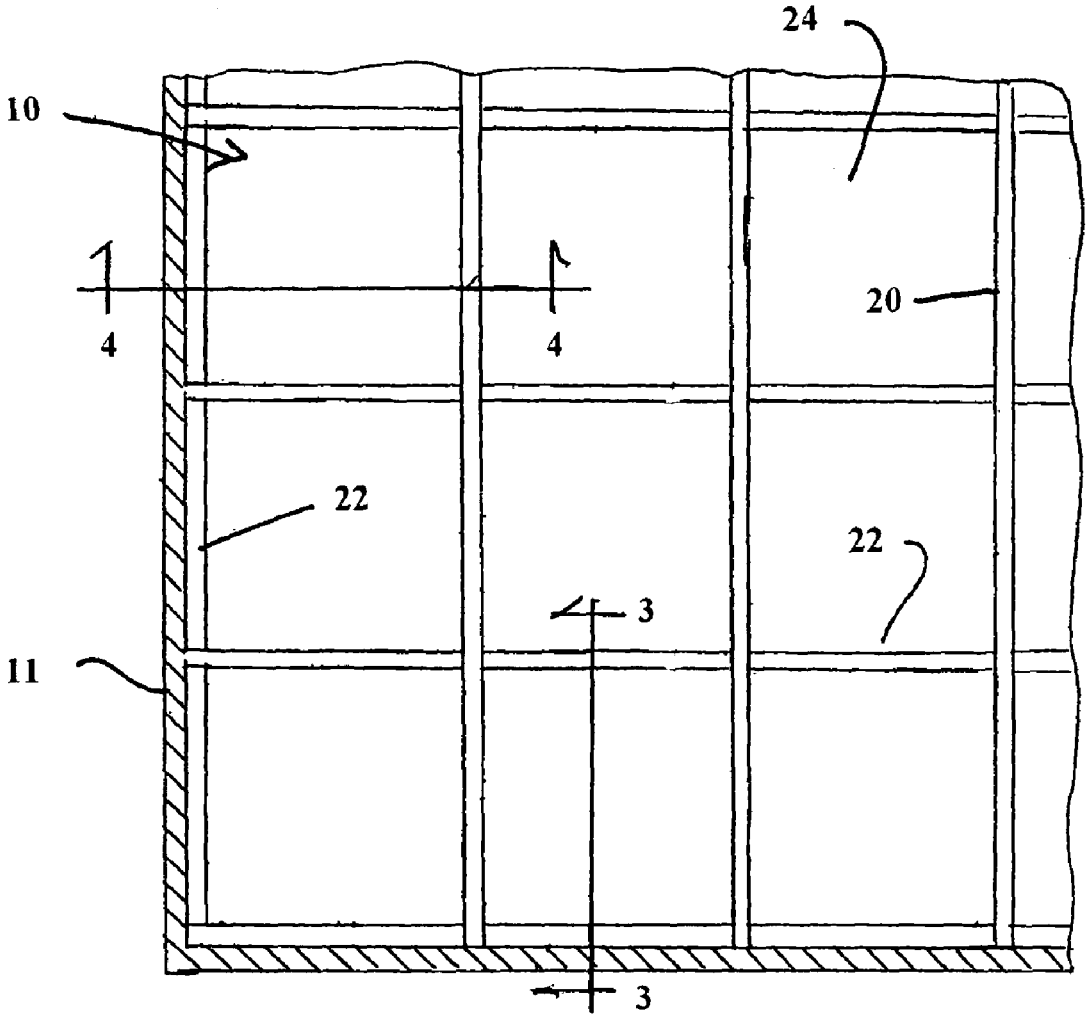
FIG. 2 is a plan view looking up at a portion of the ceiling of FIG. 1.

Referring to FIGS. 1 and 2, there is shown a suspended ceiling 10 installed in a room bounded by walls 11, 13. Suspended ceiling 10 is formed of wooden or simulated wooden components presenting an attractive and aesthetic accompaniment to the room. Ceiling 10 includes a plurality of support members 15 forming a grid of rectangular or square openings or cells between the walls of the room. The support members include runners 20 that intersect with cross members 22. The runners 20 extend from wall-to-wall. The cross members 22 extend between one runner and the next in perpendicular relationship to the runners. A drop-in ceiling panel 24 is located in each of the cells formed in the grid.

Figure 5:
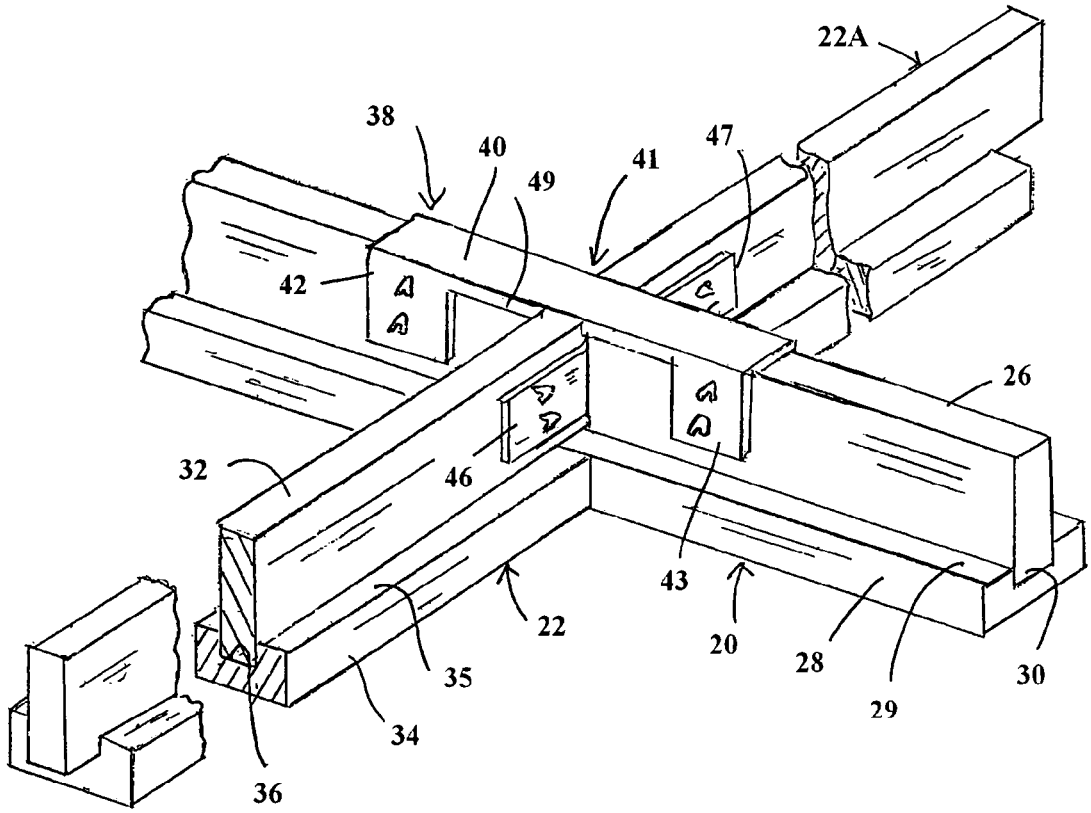
FIG. 5 is a view in perspective taken from above showing an intersection of a runner and two cross members and showing a connector in place to hold them together at the intersection.

Each of the support members has an inverted "T" shaped cross section that includes a vertical stringer and a horizontal base. The runners and the cross members have the same cross-sectional dimensions. As shown in FIG. 5, a runner 20 includes a vertical stringer 26 and a horizontal base 28. The base 28 has a central groove 30. The lower edge of the stringer 26 is installed in the groove 30 and held therein by suitable means such as glue. A sideway ledge 29 is formed on the base 28 on either side of the stringer 26.

In similar fashion, FIG. 5 shows a cross member 22 is formed of a vertical stringer 32 and a horizontal base 34. A central groove 36 in the base 34 accommodates the lower edge of the stringer 32 held therein by suitable means such as gluing. A sideway ledge 35 is formed on both sides of base 34 extending away from the stringer 32.

The runners and cross members fit together so as to have co-planar top and bottom surfaces. The openings in the grid formed by the runners and cross members are framed by the sideway ledges 29, 35 of the support members. Perimeter edges of the drop-in ceiling panels rest on the sideway ledges.

The runners and cross members connect in a lap-butt joint. FIG. 5 shows one form of such a lap-butt joint. The cross member base 34 is cut back from the cross member stringer 32 at the intersection with the runner 20. This is done so that the cross member stringer 32 can overlap the sideway ledge 29 of the runner 20 and butt against the side of the runner stringer 26. The cut back end of the cross member base 34 butts up against the side wall of the runner base 28.

FIG. 5 shows a connector 38 that secures first and second cross members 22, 22A to the intersecting runner 20 at an intersection designated generally at 41. The connector 38 is shown in greater detail in FIGS. 6 through 8. Connector 38 has a connector or top plate 40 that is installed at the intersection 41. The top plate 40 can be placed as shown in FIG. 5 on the top surface of the runner stringer 26 extending over the intersection 41.

Connector 38 is generally channel shaped with a first pair of legs 42 attached to top plate 40 that straddle and are fixed to a segment of runner stringer 26 on one side of intersection 41. A second pair of legs 43 attached to top plate 40 straddle and are fixed to another segment of the runner stringer 26 on the opposite side of intersection 41. The second pair of legs 43 is aligned with the first pair of legs 42. An integral shoulder 49 depends from top plate 40 and extends between the legs 42, 43.

A third pair of legs 46 straddle the stringer of the first cross member 22 near the intersection 41. A fourth pair of legs 47 straddle and are fixed to the stringer of second cross member 22A. The third and fourth pairs of legs 46, 47 are aligned and are in perpendicular relationship to the first and second pairs of legs 42, 43. The third and fourth pairs of legs are connected respectively to intermediate walls 48, 51 that extend from shoulder 49 (see FIGS. 7 and 8).

The legs of the various pairs of legs are spaced apart sufficiently to straddle the respective stringer segments that they engage. The first through fourth pairs of legs are connected to top plate 40. Connector 38 thereby holds the two cross members in place with respect to the intersecting runner 20.

Figure 6:
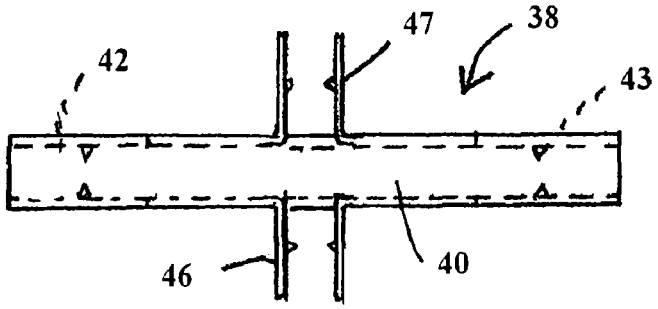
FIG. 6 is a top view of the connector of FIG. 5.
Figure 7:
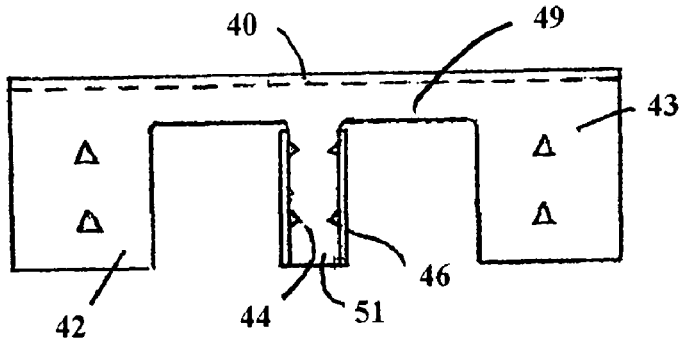
FIG. 7 is a side view of the connector of FIG. 5.
Figure 8:
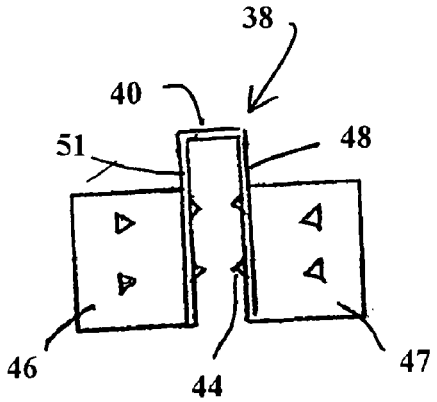
FIG. 8 is an end view of the connector of FIG. 5.

The various legs extend in perpendicular relationship to the top plate 40 and can be fixed to the support member stringers by suitable means. As shown in FIGS. 6 through 8, the various legs have inwardly directed prongs or barbs 44 that dig into or apply pressure to the sides of the corresponding stringers.

The connector 38 can be made of a suitable material such as galvanized steel, aluminum or an equivalent molded plastic. In the particular embodiment of the connector shown in FIGS. 6 through 8, the connector is advantageously made from a single channel member. The third and fourth pairs of legs are cut out from the side walls of the channel member and bent into position to form the legs in proper position to straddle the cross member.

Figure 3:
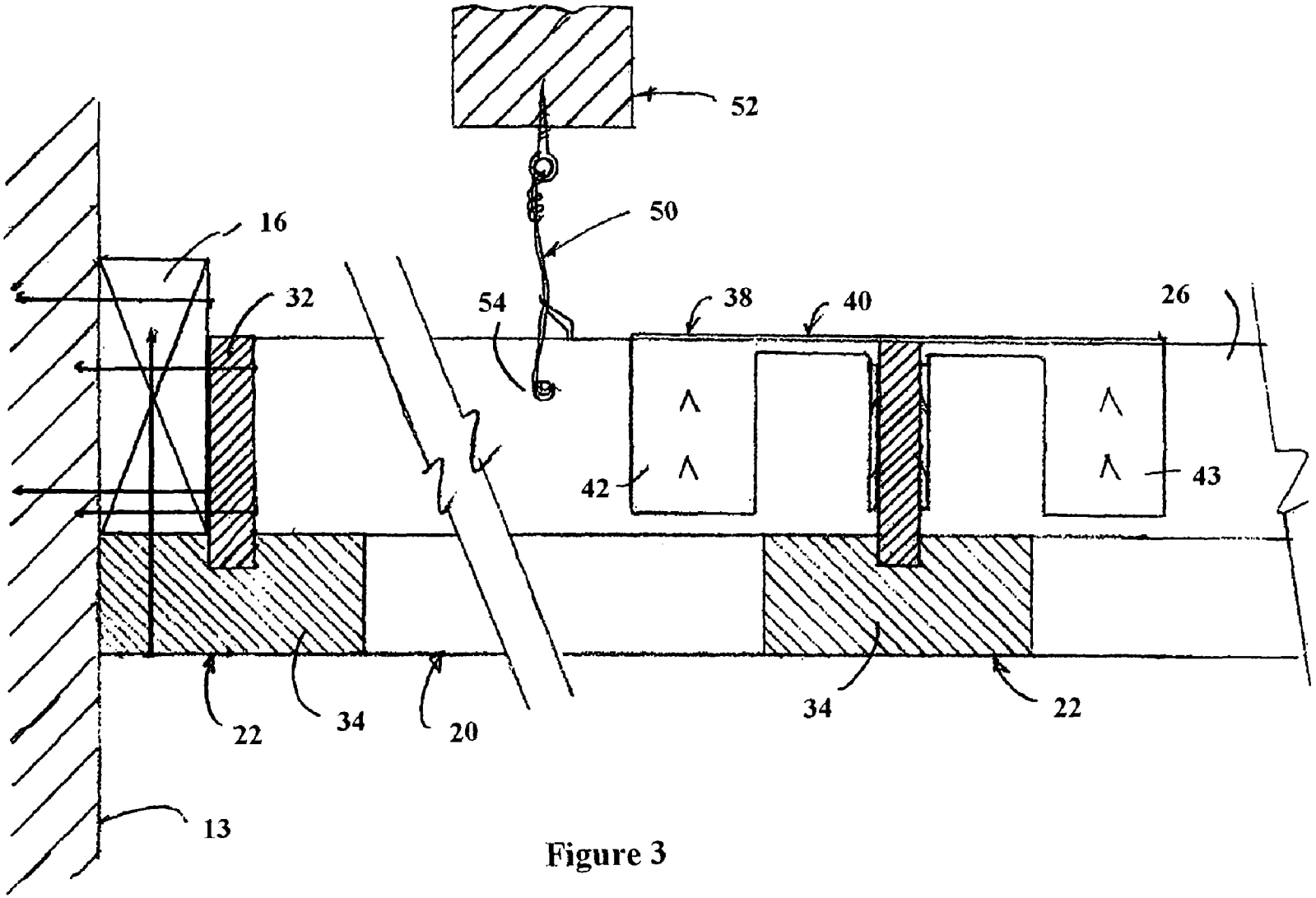
FIG. 3 is an enlarged view partly in section of a portion of the ceiling of FIG. 2 taken along the line 3-3 thereof.

FIG. 3 is a side view of a runner 20 installed with respect to a wall 13. Hanger members such as wires 50 are connected to overhead structures such as ceiling joists 52 and engage attachment openings 54 located in the stringer 26. As shown, a perimeter member 16 is fastened to wall 13 at an elevation above the base 28 of runner 20. The runner 20 abuts directly to wall 13 at both sides of the room. The top of base 28 of runner 20 is abutted to the bottom of perimeter member 16 and fastened. Cross members 22 install parallel to perimeter member 16, with the top of base 34 abutted to the bottom of the perimeter member and fastened to perimeter member 16 through stringer 32.

Figure 4:
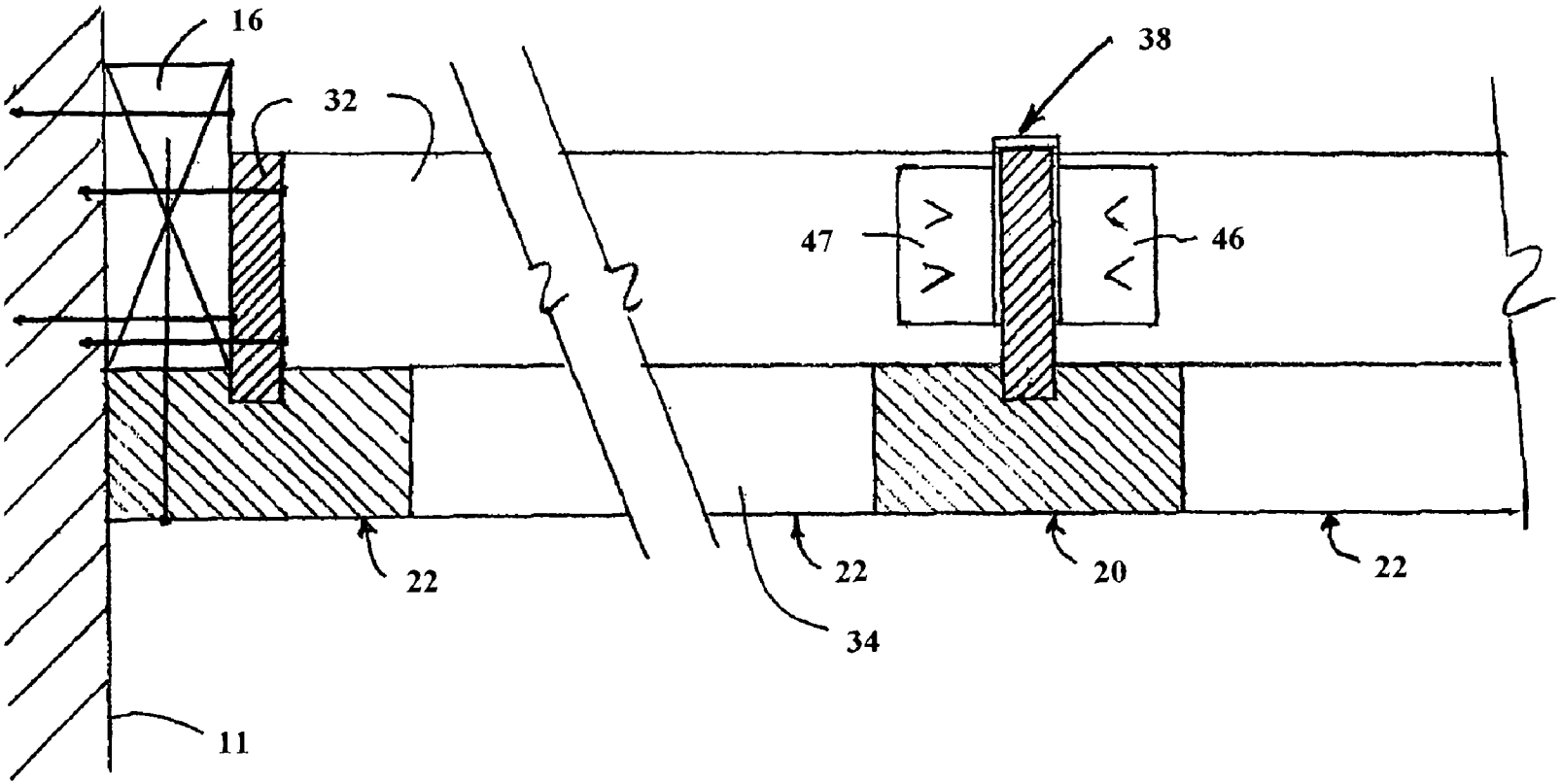
FIG. 4 is an enlarged view partly in section of a portion of the ceiling of FIG. 2 taken along the line 4-4 thereof.

FIG. 4 shows a side view of a cross member 22 at the perimeter of the suspended ceiling framework. A perimeter member 16 is fixed to the wall 11. The end of cross member 22 is cut off so that the end of cross member 22 abutts to wall 11. The top of base 34 is abutted to the bottom of perimeter member 16 and fastened.

While certain embodiments of the invention have been shown and described, it will be apparent to those skilled in the art that deviations from the embodiments disclosed can be made without departing from the scope and spirit of the invention.

The embodiments of the invention in which an exclusive property or privilege is claimed are defined as follows:

1. A suspended ceiling assembly for installation in a room bounded by walls and overhead structure from which to suspend a ceiling, comprising:

a drop-in ceiling panel framework connectable to overhead structure of a room and formed of a plurality of support members for installation between the walls of a room, said support members including runners and cross members disposed in intersecting relationship forming cells for receipt of drop-in ceiling panels, said runners and cross members positioned at intersections whereby a runner is continuous through the intersection and first and second cross members abut and are intersected by the runner at the intersection; a plurality of drop-in ceiling panels installed in the cells formed by the runners and the cross members;

a number of connectors connecting the runners and cross members at points of intersection, each connector including:

a top plate;

a first pair of legs straddling the runner and wherein each leg is fixed to a side surface of the runner on one side of the intersection;

a second pair of legs straddling the runner and wherein each leg is fixed to a side surface of the runner on the side of the intersection across the first pair of legs;

a third pair of legs straddling a first of the intersecting cross members and wherein each leg is fixed to a side surface of the first of the intersecting cross members;

a fourth pair of legs straddling a second of the intersecting cross members and wherein each leg is fixed to a side surface of the second of the intersecting cross members;

said legs each connected to the top plate to hold the runner and cross members in position with respect to each other; and at least one shoulder extending downward from the top plate and between one of said cross members and said runner, wherein one of said third or fourth pair of legs extend from the shoulder.

2. The suspended ceiling assembly of claim 1 wherein: the cross members meet the runners in a lap-butt joint.

3. The suspended ceiling assembly of claim 1 wherein: each support member has an inverted T cross-sectional shape.

4. The suspended ceiling assembly of claim 3 wherein: each support member includes a vertical stringer and a horizontal base connected to a lower edge of the stringer so that there is a sideway ledge on either side of the stringer to provide a seat for a drop-in ceiling panel.

5. The suspended ceiling assembly of claim 3 wherein: the plurality of drop in ceiling panels installed in the cells are formed by the runners and cross members with peripheral edges of the ceiling panels resting on the sideway ledges of the support members.

6. The suspended ceiling assembly of claim 3 wherein: said support members are wooden.

7. The suspended ceiling assembly of claim 6 wherein: the legs of the connector have barbs that penetrate the sides of the support members.

8. The suspended ceiling assembly of claim 1 wherein: each support member includes a vertical stringer and a horizontal base connected to a lower edge of the stringer such that at least one end of the stringer extends beyond a corresponding end of the base such that the end of the stringer can connect to one of the pairs of legs and such that the end of the base abuts a side of another horizontal base.

9. The suspended ceiling assembly of claim 8 wherein: the runners are continuous from wall-to-wall of the room.

10. The suspended ceiling assembly of claim 9 including: perimeter members installed on opposing walls of the room for attachment of the cross members and ends of runners on the perimeter of the framework.

11. A suspended ceiling assembly installed in a room having sidewalls and overhead ceiling structure, comprising:

a drop-in ceiling panel framework connected to overhead structure of a room and formed of a plurality of support members for installation between the walls of a room;

said support members assembled in intersecting relationship to form a plurality of cells receiving a plurality of drop-in ceiling panels;

each support member including a vertical stringer;

said support members connected at intersections by a connector;

each connector having:

a top plate;

a first pair of legs fixed to and straddling a first stringer segment at the intersection wherein each leg is fixed to a side surface of the first stringer segment;

a second pair of legs fixed to and straddling a second stringer segment at the intersection that is opposite the first stringer segment with respect to the intersection wherein each leg is fixed to a side surface of the first stringer segment;

a third pair of legs fixed to and straddling a third stringer segment at the intersection wherein each leg is fixed to a side surface of the first stringer segment;

a fourth pair of legs fixed to and straddling a fourth stringer segment at the intersection wherein each leg is fixed to a side surface of the first stringer segment;

said legs being connected to the top plate whereby said stringer segments are held in position with respect to one another; and at least one shoulder extending downward from the top plate and between one of said cross members and said runner, wherein one of said third or fourth pair of legs extend from the shoulder.

12. The suspended ceiling assembly of claim 11 wherein: each support member has a base connected to the lower end of the stringer in a manner to provide a sideway ledge on the base on either side of the stringer to support a peripheral edge of a drop-in ceiling panel.

13. The suspended ceiling assembly of claim 12 wherein: the support members meet at the intersections in a lap-butt joint.

* * * * *